US005776550A

United States Patent [19]

Disam et al.

[11] Patent Number: 5,776,550

[45] Date of Patent: Jul. 7, 1998

[54] OXIDATION INHIBITOR COATING

[75] Inventors: Joachim Disam, Mainz, Germany; Hans-Peter Martinz, Höfen; Manfred Sulik, Reutte, both of Austria

[73] Assignee: Schwarzkopf Technologies Corporation, New York, N.Y.

[21] Appl. No.: 816,985

[22] Filed: Mar. 13, 1997

[30] Foreign Application Priority Data

Mar. 27, 1996 [AT] Austria ..... GM170/96

[51] Int. Cl.[6] ..... C23C 4/64

[52] U.S. Cl. ..... 427/452; 424/433; 424/579; 424/427; 429/457; 429/627; 429/631; 429/634; 429/662; 429/663; 429/665

[58] Field of Search ..... 427/579, 452, 427/453, 427; 428/457, 627, 631, 634, 662, 663, 665

[56] References Cited

U.S. PATENT DOCUMENTS

| | | | |
|---|---|---|---|
| 3,690,686 | 9/1972 | Prasse et al. | 427/455 |
| 4,160,048 | 7/1979 | Jaeger | 427/455 |
| 4,701,356 | 10/1987 | Bose et al. | 427/456 |
| 5,246,736 | 9/1993 | Goujard et al. | 427/249 |
| 5,455,068 | 10/1995 | Aves et al. . | |

FOREIGN PATENT DOCUMENTS

| | | |
|---|---|---|
| 318 345 A | 1/1974 | Austria . |
| 206 973 A2 | 12/1986 | European Pat. Off. . |
| 2 677 042 | 12/1992 | France . |

*Primary Examiner*—Janyce Bell

*Attorney, Agent, or Firm*—Morgan & Finnegan, L.L.P.

[57] ABSTRACT

The invention relates to an oxidation inhibitor coating for high-melting metals selected from the group of molybdenum, tungsten, tantalum and niobium and/or alloys thereof. The oxidation inhibitor coating comprises 1 to 14% by weight boron, 0.1 to 4% by weight carbon and the balance silicon.

6 Claims, No Drawings

OXIDATION INHIBITOR COATING

BACKGROUND OF THE INVENTION

1. Field of the Invention

The invention relates to an oxidation inhibitor coating, and more particularly to an oxidation inhibitor coating applied to a substrate comprising a high-melting metal selected from the group molybdenum, tungsten, tantalum, niobium and their alloys, or composites thereof, wherein the coating comprises silicon as well as 1 to 14% by weight boron.

2. Description of the Related Art

High-melting metals have the properties of retaining their strength up to highest temperatures. However, a problem is the fact that such metals and alloys have only low resistance to oxidation when subjected to high air temperatures of over 400° C., or to other oxidizing media.

For the purpose of reducing such high susceptibility to oxidation, it is known to apply suitable protective coatings to the surface of the high-melting metals. Particularly, the application of coatings based on silicon, which, by a diffusion annealing treatment, jointly form with the high-melting metal a silicide, has often been used for this purpose. When high-melting metals coated in such a way are exposed to an oxygen-containing atmosphere at high temperatures, an oxide layer forms on the surface of the silicide, such layer of oxide acting as a protective coating against further oxidation. If coating of pure silicon is applied to the high-melting metal, the oxide layer on the layer of silicide is $SiO_2$. However, pure $SiO_2$ forms relatively slowly and has a high melting point, so that such a coating has poor crack-healing properties especially when the high-melting metal is used at temperatures below 1200° C., and consequently is an inadequate protection against oxidation in many cases.

For the above-mentioned reasons, the use of modified coatings, especially of coatings based on two materials such as SiC, SiB, SiGe, SiMn, SiTi, SiCr, but also based on three materials such as SiCrAl, SiTiAl, SiCrB, SiCrTi and SiCrFe, has gained acceptance in practical life. The use of modified coatings based on silicon has the advantage that the silicide coatings form lower-melting oxide mixtures as compared to pure $SiO_2$, so that such coatings have good crack-healing properties and protect the surface of the high-melting metal across a wide temperature range. The antioxidation coatings can be applied by all sorts of different coating methods such as plasma spraying, electrophoresis, melt flow electrolysis, melt immersion methods, CVD- or PVD-method, by applying a slurry of the desired powder mixture to the surface of the high-melting metal (slurry coating), or by curing the high-melting metal in a powder mixture with activator (pack cementation). Thereafter, in case of the low-temperature coating methods, a diffusion annealing process is carried out for forming the layers of silicide, at temperatures between 1200° C. and 1600° C., under protective gas or in a high vacuum. In connection with high-temperature coating methods (melt flow electrolysis, melt immersion method, CVD-process, pack cementation, and plasma spraying as well, as a rule), layers with adequate thickness are precipitated, so that the layers of silicide can form in the course of oxidation during use, without permitting oxygen to penetrate the coating to any greater extent.

A drawback of such known oxidation inhibitor coatings, however, is that their adhesion is often not very good, and that they, furthermore, show a certain porosity and unevenness.

SUMMARY OF THE INVENTION

An object of the present invention, is therefore to create an oxidation inhibitor coating for high-melting metals that has enhanced adherence of the coating, uniformity and tightness, and therefore offers distinctly improved protection against oxidation versus oxidation inhibitor coatings of the type known heretofore.

According to the present invention, this and other objects of the invention are accomplished by providing an oxidation inhibitor coating comprising 0.1 to 4% by weight carbon in addition to boron and silicon.

The foregoing specific objects and advantages of the invention are illustrative of those that can be achieved by the present invention and are not intended to be exhaustive or limiting of the possible advantages which can be realized. Thus, these and other objects and advantages of this invention will be apparent from the description herein or can be learned from practicing this invention, both as embodied herein or as modified in view of any variations which may be apparent to those skilled in the art. Accordingly, the present invention resides in the novel parts, constructions, arrangements, combinations and improvements herein shown and described.

DESCRIPTION OF THE PREFERRED EMBODIMENTS

It was found in this connection that an oxidation inhibitor coating comprising 5 to 12% by weight boron and 0.5 to 3% by weight carbon, the balance silicon, produces particularly good results.

The oxidation inhibitor coating according to the invention has been tested with excellent results both for massive substrates consisting of high-melting metals, and intermediate layers consisting of these materials.

It came as a complete surprise, and to an extent that could not be expected, that such small components of carbon in the oxidation inhibitor coating could lead to improvements in the resistance to oxidation which, versus pure boron-silicon coatings, may reach the factor 2 under certain application conditions. The carbon added for producing the protective coating serves not only as an alloying element, but also as an activator which, in connection with the high-temperature coating, removes diffusion-inhibiting oxygen in the form of CO or $CO_2$ in the course of the heat treatment, or also during the first time of use in an oxidizing atmosphere. This was reflected by the fact that the carbon content in the heat-treated oxidation inhibitor coating, or in an oxidation inhibitor coating that had already been in use for a brief time at an elevated temperature, was lower by a factor of up to 10 than the amount of carbon applied originally. Thin carbon component, which is initially reduced, then stabilizes, and then remains largely constant until the oxidation inhibitor coating fails.

The special oxidation-inhibiting effect of the carbon was in no way foreseeable because a person of ordinary skill in the art primarily had to expect carburization of the substrate material on account of the carbon.

The thicknesses of the oxidation inhibitor coating according to the invention that are of interest in practical application are in the range between 50 μm and 500 μm. Coating thicknesses between 100 μm and 300 μm have been successfully used in connection with a particularly preferred embodiment of the oxidation inhibitor coating.

Basically, oxidation inhibitor coatings according to the invention can be produced by all known coating methods. However, atmospheric plasma spraying and the slurry method have been found to be particularly advantageous coating methods.

The invention is further explained in the following examples.

EXAMPLE 1

Cylindrical test specimens with 10 to 25 mm diameter and 50 to 250 mm length made of molybdenum were sandblasted on their surfaces and all sharp edges were rounded. A powder mixture of 880 g silicon powder, 100 g boron powder and 20 g carbon powder was mixed for 30 minutes in a tumbling mixer. Subsequently, a slurry was prepared in the tumbling mixer by adding 560 ml colorless nitro-lacquer dissolved in 140 ml nitro-dilution, and four-hour homogenizing of the mixture in the mixer. The test specimens were coated by spraying them with the slurry. Following 24 hours of air drying, the test specimens were subjected to protective gas annealing ($H_2$, 1 bar) for 2 hours at 1370° C., which completely removed the lacquer components of the slurry. Thereafter, poorly adhering slurry residues were removed from the test specimens, the specimens were visually inspected for cracks or peeling spots, and newly coated when necessary. Test specimens coated in this manner had coating thicknesses in the range of 50 to 100 μm. For testing the resistance to oxidation, the coated test specimens were annealed in air at 1200° C., whereby it was found that the average useful time until failure of the oxidation inhibitor coating came to 3000 hours. For comparison purposes, test specimens were coated in the same way with a slurry of the same composition, but without carbon components, and also tested in air at 1200° C. It was found that with test specimens (without carbon components) coated in this way, the average useful life came to only about 2000 hours.

EXAMPLE 2

Plate-like test specimens with the dimensions 300 mm×200 mm×6 mm made of molybdenum were sandblasted on their surfaces, and all edges and corners were rounded. Subsequently, the test specimens were coated by atmospheric plasma spray coating. The spray powder used was prepared as follows: 8.8 kg silicon powder, 1.0 kg boron powder and 0.2 kg carbon powder was mixed, subsequently sintered for 3.5 hours under hydrogen at 1350° C. to 1380° C., and a powder fraction with a grain size in the range of 36 to 120 μm was obtained by screening the mixture. Plasma spraying as such was carried out with the usual adjustments to an average coating thickness of 250 to 300 μm, which was obtained after a number of spraying operations. With annealing of the test specimens at 1400° C. in air, an average useful life of 300 hours was achieved.

EXAMPLE 3

Plate-like specimens as described in Example 2, but consisting of tungsten, were coated with the same spray powder and under the same conditions as described in Example 2. With annealing of the tungsten specimens coated in this manner, at 1400° C. in air, an average useful life of 200 hours was achieved.

Although illustrative preferred embodiments have been described herein in detail, it should be noted and will be appreciated by those skilled in the art that numerous variations may be made within the scope of this invention without departing from the principle of this invention and without sacrificing its chief advantages. The terms and expressions have been used herein as terms of description and not terms of limitation. There is no intention to use the terms or expressions to exclude any equivalents of features shown and described or portions thereof and this invention should be defined in accordance with the claims which follow.

We claim:

1. An oxidation inhibitor coating applied to a substrate consisting of a high-melting metal selected from the group consisting of molybdenum, tungsten, tantalum, niobium and their alloys, or composites thereof, said coating consisting essentially of silicon, 1 to 14% by weight boron, and 0.1 to 4% by weight carbon.

2. The oxidation inhibitor coating according to claim 1, consisting essentially of 5 to 12% by weight boron, 0.5 to 3% by weight carbon, and the balance silicon.

3. The oxidation inhibitor coating according to claim 2, wherein the coating has a layer thickness of between 100 and 300 μm.

4. The oxidation inhibitor coating according to claim 1, wherein the coating has a layer thickness of between 100 to 300 μm.

5. The oxidation inhibitor coating according to claim 1, wherein the coating is formed by atmospheric plasma spraying.

6. The oxidation inhibitor coating according to claim 1, wherein the coating is formed by a slurry process.

* * * * *

UNITED STATES PATENT AND TRADEMARK OFFICE

CERTIFICATE OF CORRECTION

PATENT NO. : 5,776,550

DATED : July 7, 1998

INVENTOR(S) : Disam et al.

It is certified that an error appeared in the above-identified patent and that said Letters Patent is hereby corrected as shown below:

Column 4, line 36, (claim 4) after "100" delete "to" and insert –and--.

Signed and Sealed this

Twentieth Day of October, 1998

*Attest:*

Bruce Lehman

BRUCE LEHMAN

*Attesting Officer*

*Commissioner of Patents and Trademarks*